United States Patent [19]

Dove

[11] Patent Number: 4,742,587

[45] Date of Patent: May 10, 1988

[54] MEDICAL STRETCHER

[76] Inventor: Arthur J. Dove, 96 Old Colony Ave., Quincy, Mass. 02170

[21] Appl. No.: 42,831

[22] Filed: Apr. 27, 1986

[51] Int. Cl.[4] ..... A61G 1/00

[52] U.S. Cl. ..... 5/82 R; 5/112

[58] Field of Search ..... 5/82 R, 110, 111, 112, 5/114, 431

[56] References Cited

U.S. PATENT DOCUMENTS

| | | | |
|---|---|---|---|
| 2,242,311 | 5/1941 | Lucey | 5/82 |
| 2,532,837 | 12/1950 | DePuy | 5/82 |
| 2,544,977 | 3/1951 | Blank | 5/82 |
| 3,414,914 | 12/1968 | Gramins | 5/82 |
| 3,574,871 | 4/1971 | Greene | 5/82 |
| 3,671,983 | 6/1972 | Bertolet | 5/82 |
| 3,949,435 | 4/1976 | Dionne | 5/431 |
| 4,190,915 | 3/1980 | Birt | 5/505 |

FOREIGN PATENT DOCUMENTS

| | | | |
|---|---|---|---|
| 33636 | 7/1905 | Switzerland | 5/82 |
| 70215 | 11/1914 | Switzerland | 5/82 |

*Primary Examiner*—Alexander Grosz

[57] ABSTRACT

The following specification discloses a medical stretcher which includes first and second frame members and a flexible support member. The first and second frame members connect together to form the stretcher frame. The stretcher frame has first and second long sides. The support member is generally rectangular in configuration, is formed of a mesh material and has a series of spaced straps extending from each of its long sides. The straps extending from one long side are fastened around the first long side and the straps extending from the other side are fastened around the second long side. Hook and loop type strips are used as fasteners on the straps. The first and second frame members and the flexible support member can be disengaged for easy storage. The assembly of the first and second frame members and the support member can be done at the scene of an accident with minimum movement of the patient on to the stretcher.

3 Claims, 1 Drawing Sheet

MEDICAL STRETCHER

BACKGROUND OF THE INVENTION

This invention relates generally to a medical stretcher and more specifically to trauma stretcher which allows a patient at the scene of an accident to be placed thereon with a minimum of movement.

SUMMARY OF THE INVENTION

The following specification discloses a medical stretcher which includes first and second frame members and a flexible support member. The first and second frame members connect together to form the stretcher frame. The stretcher frame has first and second long sides. The support member is generally rectangular in configuration, is formed of a mesh material and has a series of spaced straps extending from each of its long sides. The straps extending from one long side are fastened around the first long side and the straps extending from the other side are fastened around the second long side. Hook and loop type strips are used as fasteners on the straps. The first and second frame members and the flexible support member can be disengaged for easy storage. The assembly of the first and second frame members and the support member can be done at the scene of an accident with minimum movement of the patient on to the stretcher.

BRIEF DESCRIPTION OF THE DRAWINGS

Further details are explained below with the help of the examples illustrated in the attached drawings in which.

DESCRIPTION OF THE PREFERRED EMBODIMENT(S)

Figure 1:
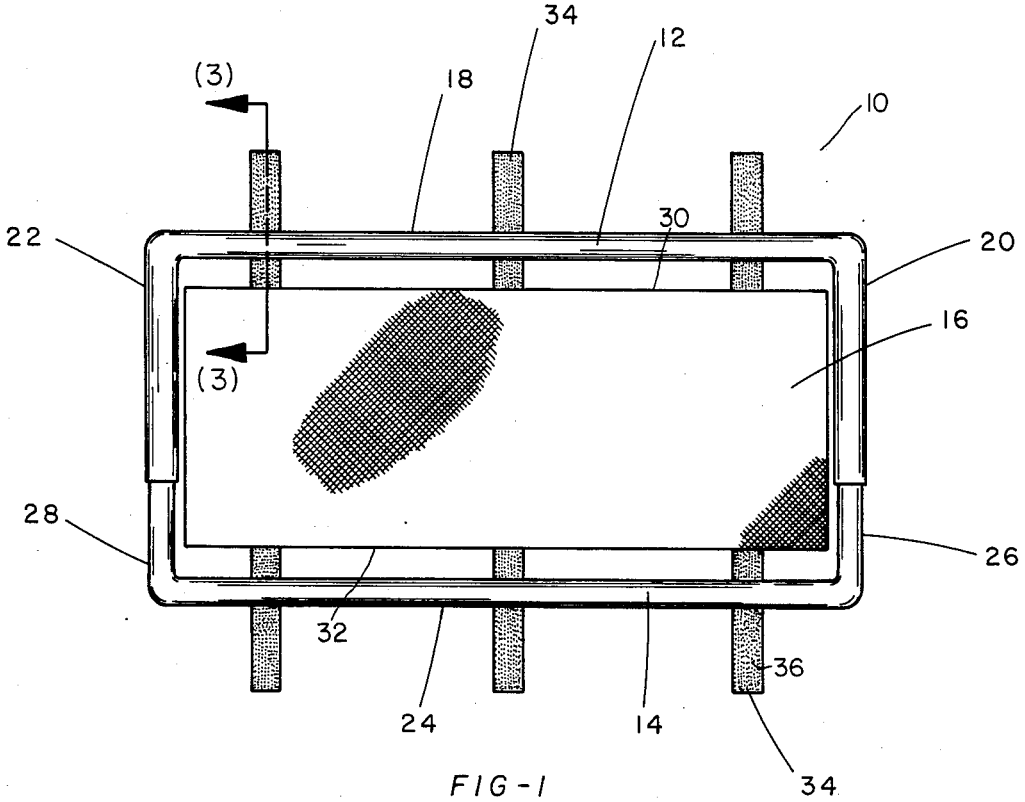
FIG. 1 is a top plane view of the stretcher, prior to engagement of the hook and loop type fasteners of the straps according to the present invention.
Figure 2:
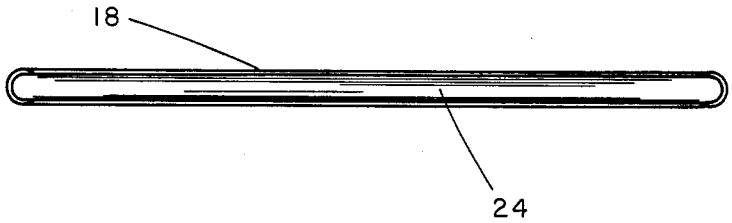
FIG. 2 is a side elevational view of the stretcher shown in FIG. 1.
Figure 3:
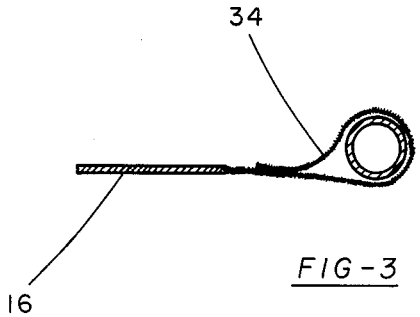
FIG. 3 section taken on line 3—3 of FIG. 1 showing the engagement of the Velcro fastener of a strap.

There is shown in drawings a medical stretcher 10 comprising a first frame member 12, a second frame member 14 and a flexible support member 16. The first and second frame members 12, 14 are formed of tubular plastic material, such as polyethylene. The first frame member 12 is formed to provide a first long side 18, a first short side 20 as one integral terminal end and a second short side 22 as an integral other terminal end. The first short side 20 and the second short side 22 are in right angle relation to the first long side 18 and in spaced parallel relation to each other. The second frame member 14 is formed to provide a second long side 24, a third short side 26 as one integral terminal end and a fourth short side 28 as an integral other terminal end. The third short side 26 and the fourth short side 28 are in right angle relation to the second long side 24 and in spaced parallel relation to each other. The first and second short sides 20, 22 are of slightly larger diameter that the third and fourth short sides 26, 28.

The support member 16 is generally rectangular in configuration and is manufactured of a flexible, web-like plastic material. The support member 22 includes a first long side 30 and a second long side 32. The first and second long sides 30, 32 each having a series of spaced straps 34 extending therefrom. Each of the straps 34 has an underside which is provided with a hook and loop type fastening 36 extending to its free terminal end.

The medical stretcher 10 is assembled, at the scene of an accident for example, by placing the support member 16 on the ground, under the patient, with the straps 34 fully extended. The fourth short side 28 of the second frame member 14 is inserted into second short side 22 of the first frame member and the third short side 26 of the second frame member 14 is inserted into first short side 20 of the first frame member. The engagements are press fits. The engaged subassembly of the first and second frame members 12, 14 is positioned on the support member 16 which is resting on a ground and around the patient. In this position, the straps 34 extend beyond the area defined by the first and second frame members 12, 14. The straps 34 on the side of the first frame member 12 are wrapped around the first long side 18 and the straps 34 on the side of the second frame member 14 are wrapped around the second long side. Each of the hook and loop type fasteners on the straps 34 engages itself to complete the assembly.The patient can now be moved. When the use of the medical stretcher 10 is completed, the first and second frame members 12, 14 are disengaged as are the straps 34 and the parts can be easily stored in an ambulance, for example.

What I claim is:

1. A medical stretcher comprising a first frame member a second frame member and a flexible support member, the first and second frame members press fitted together to form a frame, the frame having a first long side and a second long side, the support member having a first side and a second side, the first and second sides each having a series of spaced straps extending therefrom, the straps comprising separable fastener means, the straps extending from the first side engaging the first long side and the straps extending from the second side engaging the second long side, the first and second frame members being formed of a tubular material and each having a first terminal end and a second terminal end, the first terminal end of the first frame member extending within and circumscribed by the first terminal end of the second frame member and the second terminal end of the first frame member (fitted) extending within and circumscribed by the second terminal end of the second frame member, said first and second frame members and the flexible support member being adapted to be disengaged for easy storage.

2. A medical stretcher as set forth in claim 1 wherein the straps have hook and loop type fasteners associated therewith, the fasteners holding each of the straps in circumscibing relation to the first and second long sides.

3. A method of assembling a medical stretcher comprising a first frame member a second frame member and a flexible support member, the first and second frame members formed of a tubular member and each having a first terminal end and a second terminal end, the first and second frame members being placed on the support member which is resting on a surface, the first terminal end of the first frame member extending within and circumscribed by the first terminal end of the second frame member and the second terminal end of the first frame member extending within and circumscribed by the second terminal end of the second frame member, to form a press fitted frame, the frame having a first long side and a second long side, the support member having a first side and a second side, the first and second sides each having a series of spaced straps extending therefrom, the straps comprising separable fastener means, the straps extending from the first side being engaged to the first long side and the straps extending from the second side being engaged to the second long side, said first and second frame members and the flexible support member being adapted to be disengaged for easy storage.

* * * * *